United States Patent [19]

Castaldo

[11] 4,275,577

[45] Jun. 30, 1981

[54] LOCK DEVICE

[76] Inventor: Jerry L. Castaldo, 413 S. Fairfield, Lombard, Ill. 60148

[21] Appl. No.: 132,850

[22] Filed: Mar. 24, 1980

[51] Int. Cl.[3] ..... E05B 35/08; E05B 9/04

[52] U.S. Cl. ..... 70/337; 70/375

[58] Field of Search ..... 70/337, 338, 340, 341, 70/342, 343, 375, 364 A

[56] References Cited

U.S. PATENT DOCUMENTS

| | | | |
|---|---|---|---|
| 1,598,523 | 8/1922 | Heyer | 70/337 |
| 1,650,564 | 11/1927 | Wolff | 70/337 |
| 1,685,022 | 9/1928 | Clearer | 70/337 |
| 1,788,834 | 1/1931 | Hurd | 70/337 |
| 2,009,640 | 7/1935 | Stone | 70/337 |
| 3,771,340 | 11/1973 | Krakstrom | 70/338 |
| 3,875,773 | 4/1975 | Thimot | 70/337 |
| 3,973,421 | 8/1976 | Patriquin | 70/364 R |
| 4,075,879 | 2/1978 | Christopher | 70/337 |

*Primary Examiner*—Robert L. Wolfe
*Attorney, Agent, or Firm*—McWilliams, Mann & Zummer

[57] ABSTRACT

A lock arrangement is provided which may be actuated by two different keys. A master key may be used to lock and unlock the device. A subordinate key may be used to lock the device only. The lock is of the pin-tumbler type in which the lock's rotatable core plug includes a shallow, longitudinal step groove cut into the top of the core plug. The subordinate key is identical to the master key except that one or more of the subordinate key's bittings is cut deeper than the corresponding groove or grooves on the master key, the additional depth corresponding to the depth of the step. When the master key is inserted in the keyway in the core plug, the pin tumblers are raised in the normal fashion so that the tops of the pins are even with the shear line between the core plug and the cylinder. The core plug may then be rotated in either direction. When the subordinate key is inserted in the core plug keyway, one or more of the tumbler pins is raised so that the top of the pins is located at a point below the shear line, but at or slightly above the level of the bottom of the step groove. In this manner the core plug may only be turned in one direction so as to be able to lock, but not unlock, the device.

4 Claims, 8 Drawing Figures

FIG. 1
PRIOR ART
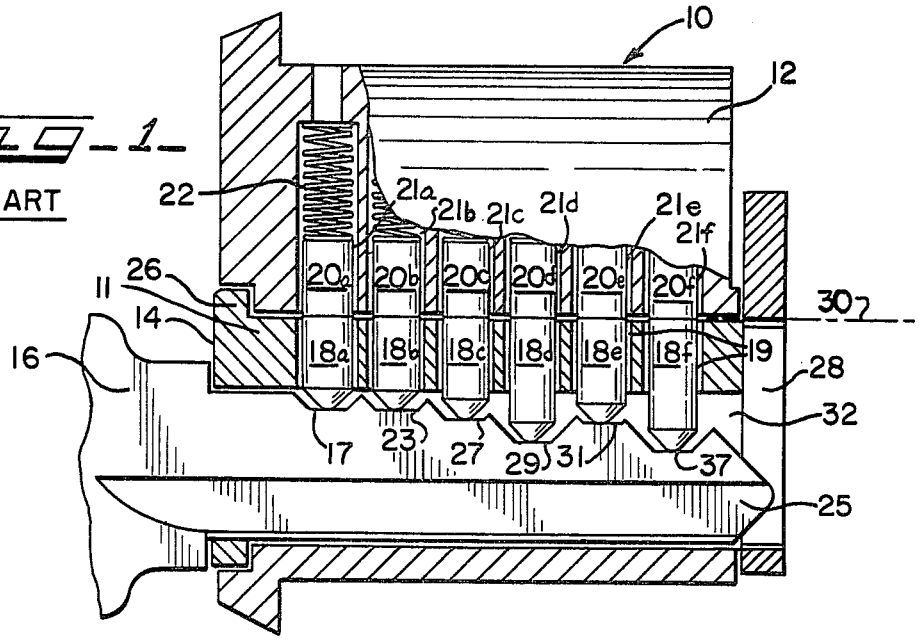
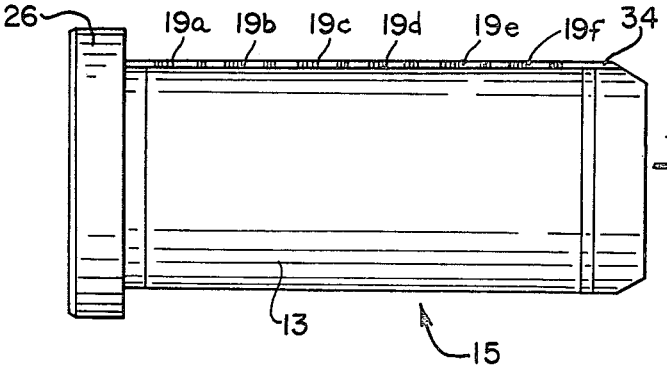
FIG. 4
FIG. 2
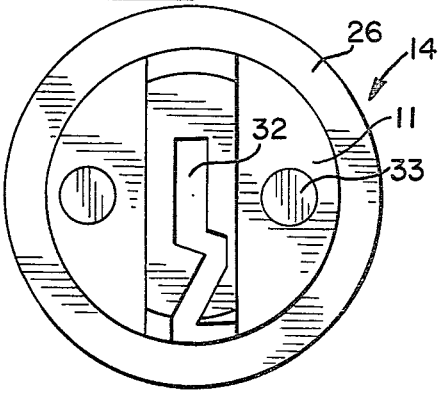
PRIOR ART
FIG. 3
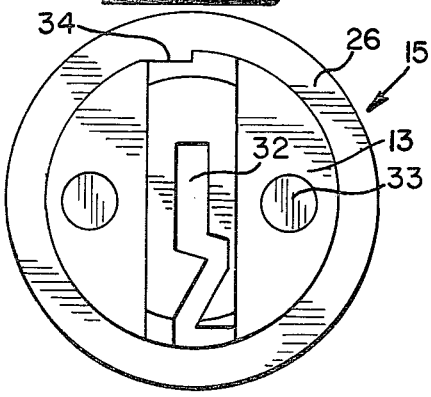

LOCK DEVICE

BACKGROUND OF THE INVENTION

This invention relates to cylinder locks which are responsive in different ways to different keys. Such a lock is useful in applications where certain persons may be authorized to lock, but not unlock, a door. Such a situation arises in a commercial or industrial setting where an entrance door would be unlocked during working hours, but locked during non-working hours. The owner of the premises may desire that an employee be able to lock a door at the end of the day, but not have the ability to unlock it thereafter, the ability to do both being reserved to the owner. It is thus desirable to have a lock responsive to two keys, both of which can perform the locking operation, while only one of which can perform the unlocking operation.

Prior art devices directed to this problem will be seen in the following U.S. Pat. Nos.:

3,771,340
3,875,773
3,973,421

In the prior art devices wafers or discs are used as tumblers. Neither of these arrangements is thought to be as secure as the pin-tumbler lock employed in the device embodying the present invention. An additional and important difference between the present invention and those disclosed in the above listed prior art patents is that the present invention may be utilized in standard pin-tumbler locks, including those already installed, by merely substituting the core plug described hereinafter for the typical core plug and using a subordinate key. In this manner, ease and economy of manufacture and installation are assured.

DESCRIPTION OF THE DRAWINGS

In the accompanying drawings which form a part of the specification and wherein like numerals and letters refer to like parts:

FIG. 1 is a partially broken away section view of a typical pin-tumbler lock as known in the prior art.

FIG. 2 is a rear end view of the core plug shown in FIG. 1.

FIG. 3 is a rear end view of a core plug constructed in accordance with the present invention.

FIG. 4 is a side elevation of the core plug shown in FIG. 3.

DETAILED DESCRIPTION

Figure 5:
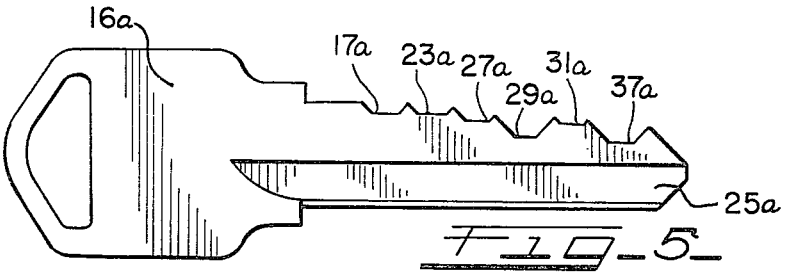
FIG. 5 shows a master key.

Referring now to the drawings, in FIG. 1 is shown a typical pin-tumbler lock 10. Core plug 14 comprising barrel section 13 and flange 26 is rotatably disposed in cylinder 12 and held in place by flange 26 and tailpiece 28. Pins 18(*a–f*) are slidably disposed in pin chambers 19(*a–f*) in plug 14. Drivers 20(*a–f*) are slidably disposed in driver chambers 21(*a–f*) in cylinder 12. Each pin chamber 19 is aligned with a driver chamber 21. The drivers 20 are biased downwardly against the pins 18 by means of springs 22. Key 16 is shown inserted into keyway 32 in core plug 14. Each one of pins 18(*a–f*), which may vary in length, is raised to an imaginary shear line 30 by means of bittings 17, 23, 27, 29, 31, and 37 on key bit 25.

FIG. 2 shows a rear end view of core plug 14 as shown in FIG. 1. Keyway 32 is shown flanked by threaded sockets 33 which are used to attach tailpiece 28 to the rear end of core plug 14. Tailpiece 28, by its rotation, activates a latching device (not shown). FIG. 3 is a rear end view of a modified core plug 15 constructed in accordance with the present invention. A step groove 34 is formed at the top of plug 15. The distance from the bottom of step groove 34 to the central axis of core plug 15 is somewhat less than the radius of barrel section 13. Step groove 34 is located on only one side of the vertical plane through the center axis of the core plug. In this embodiment, the depth of step groove 34 is approximately 0.030 inch. FIG. 4 shows a side elevation of core plug 15 and step groove 34.

Figure 6:
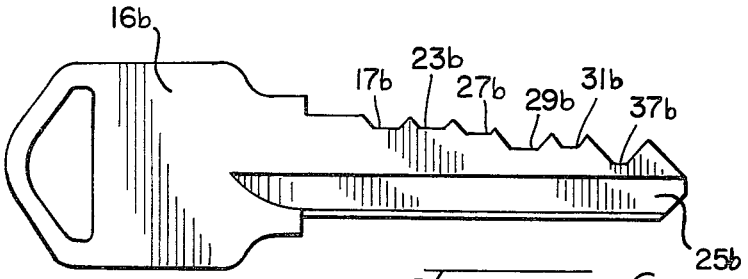
FIG. 6 shows a subordinate key.

FIGS. 5 and 6 illustrate a master key 16*a* and a subordinate key 16*b*, respectively. The subordinate key 16*b* in this embodiment differs from the master key 16*a* in that the last two bittings 31*b* and 37*b* on the subordinate key 16*b* are machined approximately 0.030 inch lower than the corresponding bittings 31*a* and 37*a* on the master key 16*a*.

Figure 7:
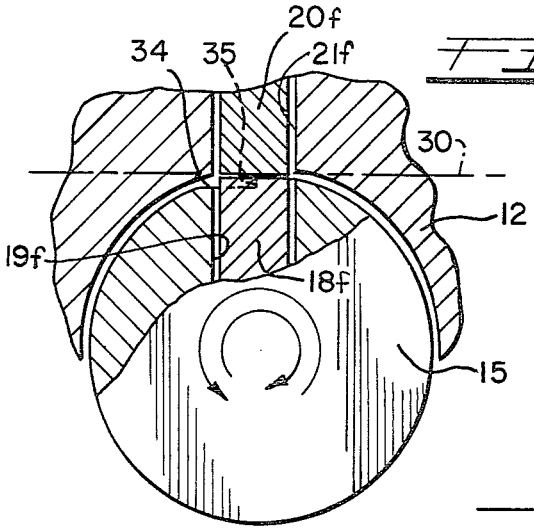
FIG. 7 is a partially broken away rear end view partially in phantom of the lock mechanism actuated by the master key.
Figure 8:
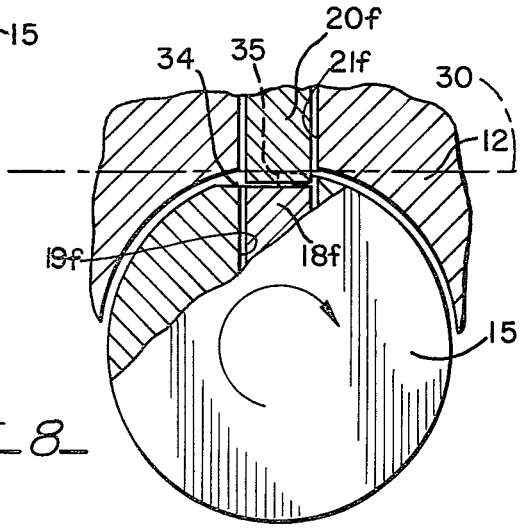
FIG. 8 is a partially broken away rear end view partially in phantom of the lock mechanism actuated by the subordinate key.

FIG. 7 shows that section of the lock including pin 18*f*, driver 20*f*, pin chamber 19*f*, and driver chamber 21*f* being actuated by bitting 27*a* on the master key. Bitting 37*a* raises pin 18*f* and driver 20*f* so that the intersection between the two is aligned with shear line 30, the line at which the outer edge of the core plug 15 meets the inner edge of the cylinder bore. In FIG. 8 the same section of the lock is shown actuated by the bitting 37*b* on the subordinate key 16*b*. Bitting 37*b*, being approximately 0.030 inch deeper than bitting 37*a*, raises pin 18*f* and driver 20*f* to a point where their intersection is aligned with the bottom of step 34.

OPERATION

In FIG. 7 it can be seen that when the master key is inserted in the keyway 32, the operation of the lock is precisely the same as it would be if the standard core plug 14 were used as opposed to modified core plug 15 shown here. Pin 18*f* and driver 20*f* are raised to the shear line 30 so that the core plug is free to rotate in either clockwise or counterclockwise direction within the cylinder 12. In FIG. 8 the lock is shown as actuated by the subordinate key bitting 37*b* which, being approximately 0.030 inch lower than bitting 37*a* in the master key, raises pin 18*f* and driver 20*f* to a point where their intersection is aligned with the bottom of step groove 34. In this configuration the pin-driver intersection lies below the shear line 30 so that clockwise or unlocking rotation of the core plug 15 within the cylinder 12 is prevented because the right side of pin chamber 19*f* engages the side of driver 20*f*. It may be seen, however, that the pin-tumbler intersection lies within the shear gap 35 which is defined as the space between the shear line 30 and the bottom of step groove 34. Since shear gap 35 is considerably wider than shear line 30, and the left side of pin chamber 19*f* is considerably lower than the right side, the core plug 15 is not prevented from rotating in a clockwise or locking direction within the cylinder 12.

It should be noted that for added security the subordinate key may be bitted so that any or all of the bittings will be lower than the corresponding bittings on the master key. It is essential that the master key be cut so as to raise all of the pins to the shear line 30. Subordinate keys may be cut so as to raise one or more of the pins to the bottom of step groove 34 and the rest of the pins to the shear line 30.

I claim:

1. A locking device selectively operable with either a master key or a subordinate key including:

a core plug adapted to be rotatably disposed within a housing including an axially extending barrel section having a generally circular cross section;

a raised annular flange section disposed at one end of said barrel section;

a plurality of radially outwardly extending coplanar chambers defined in said barrel section;

a centrally disposed axially extending keyway defined in said core plug, said chambers intersecting said keyway;

a plurality of pins, each slidably disposed within a chamber, each of said pins adapted to contact a bitting defined in a key to be inserted in said keyway;

an axially extending step groove defined in an outer periphery of said barrel section parallel to said keyway and intersecting said chambers whereby when a master key is inserted in said keyway, said pins will be urged to the outer periphery of said barrel member so as to allow rotation of said plug with respect to said cylinder in either clockwise or counterclockwise directions, but when said subordinate key is inserted in said keyway, at least one of said pins will be urged only to the outer periphery of said step groove so as to permit rotation of said plug only in one direction.

2. A locking device as in claim 1 wherein said axially extending step groove runs substantially the length of said barrel section.

3. A locking device as in claim 1 wherein said axially extending step groove has a depth of approximately 0.030 inch.

4. A locking device as in claim 1 wherein at least one bitting on said subordinate key is machined deeper than the corresponding bitting or bittings on said master key, said additional depth not exceeding the depth of said step groove.

* * * * *